United States Patent [19]

Lee

[11] Patent Number: 5,024,072

[45] Date of Patent: Jun. 18, 1991

[54] TUMBLER PIN LOCK SYSTEM

[76] Inventor: Miko Lee, No. 5, Li Hsing Lane, Chung Cheng Rd., Hsin Chuang City, Taipei Hsien, Taiwan

[21] Appl. No.: 573,701

[22] Filed: Aug. 28, 1990

[51] Int. Cl.[5] ..... E05B 19/02; E05B 27/08

[52] U.S. Cl. ..... 70/491; 70/404

[58] Field of Search ..... 70/491, 403, 404, 395

[56] References Cited

U.S. PATENT DOCUMENTS

| | | | |
|---|---|---|---|
| 1,891,214 | 12/1932 | Falk | 70/404 |
| 3,339,384 | 9/1967 | Greenwald | 70/491 |
| 4,083,211 | 4/1978 | Scherbing | 70/491 |
| 4,622,834 | 11/1986 | Hughes | 70/404 X |
| 4,735,069 | 4/1988 | Steinbach | 70/491 |
| 4,831,853 | 5/1989 | Liao | 70/491 |

*Primary Examiner*—Lloyd A. Gall

*Attorney, Agent, or Firm*—Bacon & Thomas

[57] ABSTRACT

A tumbler pin lock system comprises a lock mechanism and a key. The lock mechanism has an outer tubular casing mounted to a frame of a computer or similar electrical device. The tubular casing has an eccentric through hole for rotatably receiving a locking spindle. The locking spindle includes a driver pin sleeve having a set of bore holes, each for receiving a driver pin. A rotating shaft protrudes from a first side of the driver pin sleeve, and a protrusion with a keyway slot protrudes from a second side of the driver pin sleeve. A tumbler sleeve is provided on the rotating shaft and is fixed to the tubular casing. The tumbler sleeve has a distributed annular set of blind holes, each for receiving a tumbler spring and a tumbler pin, which are alignable with the bore holes in the driver pin sleeve. The key comprises a flattened key handle and a cylindrical portion. A set of annularly disposed semi-cylindrical slots are formed on an outer periphery of a first end of the cylindrical portion to engage with corresponding driver pins disposed in the bore holes in the driver sleeve. A key guide lug is formed inside the set of the semi-cylindrical slots to engage with the keyway slot to turn the rotating shaft relative to the tumbler sleeve to provide a locking or unlocking function. A cutout portion is formed in a middle portion of the cylindrical portion.

4 Claims, 7 Drawing Sheets

TUMBLER PIN LOCK SYSTEM

BACKGROUND OF THE INVENTION

The present invention relates to a tumbler pin lock system, and more particularly to a tumbler pin lock system for computer, in which some of its drivers are partially or completely shielded by an outer cap to prevent an unauthorized person from using the computer.

Conventionally, tumbler pin locks are provided on computers or other electrical devices. A disadvantage 1 of such tumbler pin locks is that their driver pins are exposed such that an unauthorized person may find another key (for example, a skeleton key) to pick open the lock and use the computer. There is a risk that the secret information stored in the computer may be copied or destroyed by an unauthorized person.

The present invention intends to provide a tumbler pin lock to mitigate and/or obviate the above-mentioned problem and other problems which may be encountered in prior tumbler pin locks.

SUMMARY OF THE INVENTION

The lock system according to the present invention comprises an axial pin tumbler lock and a key assembly. The lock includes an outer tubular casing, a locking spindle, a tumbler sleeve, and an outer cap. The outer tubular casing has a key-end portion with an annular groove and a threaded portion, by means of which the lock is secured to a frame (such as a computer panel). The tubular casing has an eccentric through hole for receiving the locking spindle. The tubular casing further has an annular retaining ring formed on an inner wall of the key-end portion.

The outer cap seals the key-end portion which is left outside the above-mentioned frame when the tubular casing is mounted to the frame. The outer cap is freely rotatable.

The locking spindle comprises a driver pin sleeve having a set of bore holes, each for receiving a driver pin which match and align with corresponding blind holes in the tumbler sleeve. A rotating shaft, with a threaded portion, protrudes from a first side of the driver pin sleeve. The locking spindle further has a protrusion with a keyway slot protruding from a second side thereof The keyway slot provides a fixed point for the torque arm by means of which the spindle is rotated.

A steel security pin is radially positioned into a pin hole on a circumference of the driver pin sleeve, and therein provides security against entry to be obtained by drilling the lock out. The tumbler sleeve, with a distributed annular set of blind holes each for receiving a tumbler spring and a tumbler pin, is fixed to the tubular casing with an anchoring pin which penetrates through a pin hole in the threaded portion of the tubular casing and also penetrates an anchoring hole in the tumbler sleeve. Rotation of the locking spindle constitutes the locking and unlocking action, but which is so conventional that no further description is required.

The key assembly according to the present invention comprises a flattened key handle and a cylindrical portion. A set of annularly disposed semi-cylindrical slots are formed on an outer periphery of a first end of the cylindrical portion, each of a proper depth to engage with corresponding driver pins disposed in the bore holes in the driver sleeve. A key guide lug is formed inside the set of the semi-cylindrical slots, so as to engage with the keyway slot on the rotatable shaft to provide the locking or unlocking action. An eccentric hole with a cutout portion is formed in a middle portion of the cylindrical portion. In an inner wall of the cylindrical portion, there is a retaining flange formed thereon for attaching an engaging piece of the flattened key handle in the cylindrical portion to form a complete key.

It is therefore a primary objective of the present invention to provide a lock system, wherein some of the driver pins are partially or completely shielded by the outer cap to prevent an unauthorized person from using the apparatus or device (such as a computer) equipped with the present lock system.

Another object of the present invention is to provide a lock system, in which its outer cap is freely rotatable such that it is not easily destroyed or detached from outside.

It is still another object of the present invention to provide a lock system, wherein a steel pin is anchored in the locking spindle to prevent unauthorized drilling through of the lock.

These and additional objects, if not set forth specifically herein, will be readily apparent to those skilled in the art from the detailed description provided hereunder, with appropriate reference to the accompanying drawings.

BRIEF DESCRIPTION OF THE DRAWINGS

FIGS. 4 through 7 are schematic cross-sectional views showing the operation of the lock system according to the present invention, in which FIG. 4 shows that the key is initially inserted into the lock;

FIG. 5 shows that the key is moved downwardly to align the semi-cylindrical slots on the key with the driver pins on the locking spindle;

FIG. 6 shows that the key is moved inwardly to allow a rotating shaft of the locking spindle to rotate relative to a tumbler sleeve;

FIG. 7 shows that the key is rotated through a predetermined angle to provide a pre-set locking or unlocking function.

DETAILED DESCRIPTION OF THE PREFERRED EMBODIMENTS

Figure 1:
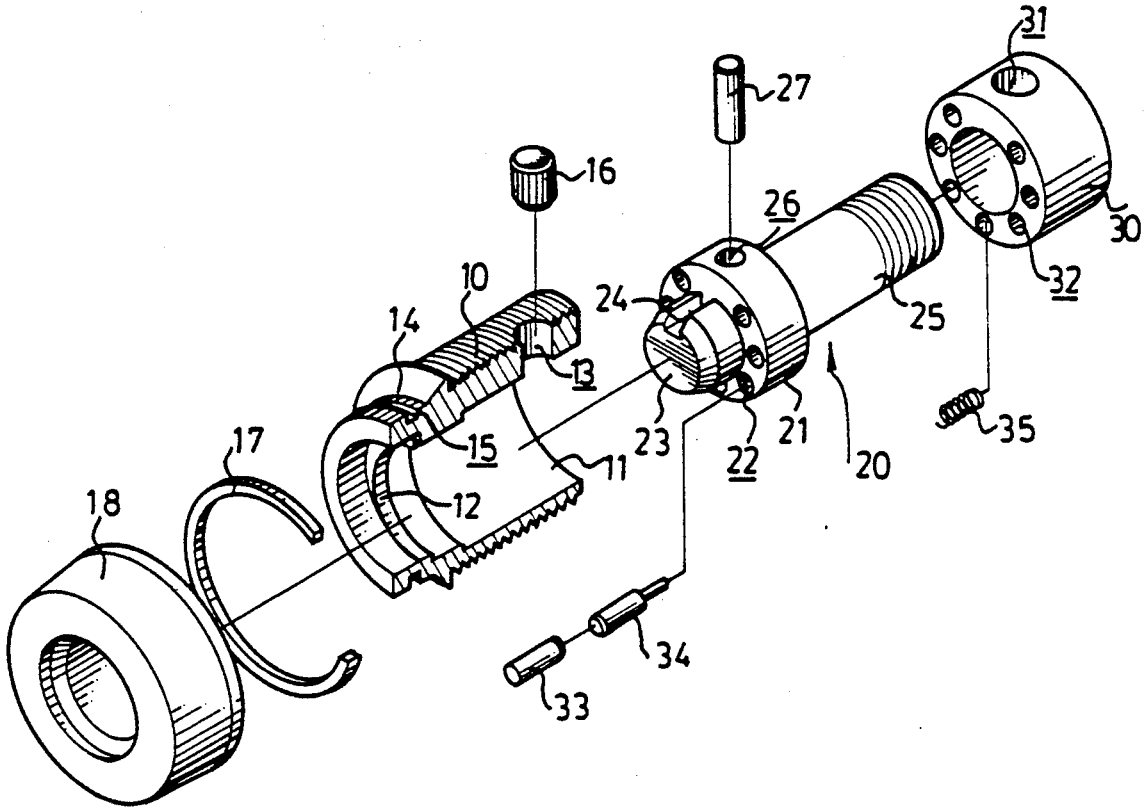
FIG. 1 is an exploded perspective view of a lock of a lock system in accordance with the present invention.

In FIG. 1 is shown a preferred embodiment of an axial pin tumbler lock of the lock system according to the present invention. The lock includes an outer tubular casing 10, a locking spindle 20, a tumbler sleeve 30 and an outer cap 18. The outer tubular casing 10 has a mounting flange 14 protruding radially from an outer periphery of the tubular casing 10. The mounting flange 14 divides the outer periphery of the tubular casing 10 into a key-end portion with an annular groove 15 and a threaded portion, the latter the means by which the lock is secured to a frame (such as a computer panel). The tubular casing 10 has an eccentric through hole 11 for receiving the locking spindle 20. The tubular casing 10 further has an annular retaining ring 12 formed on an inner wall of the key-end portion.

An annular compression ring 17 fits into the annular groove 15 on the key-end portion of the tubular casing 10. The outer cap 18, having an inner groove 19 (see FIGS. 4, 5, 6 and 7), is press fitted onto the key-end portion of the tubular casing 10, and the upper portion of the compression ring 17 which fits into the inner groove 15, while securing the cap 18 to the tubular casing 10, also provides the cap 18 with complete freedom of rotation. The outer cap 18 seals the key-end portion of the tubular casing 10 which protrudes outside the frame.

The locking spindle 20 comprises a driver pin sleeve 21 having a set of bore holes 22, each for receiving a driver pin 33 matching and alignable with corresponding blind holes 32 in the tumbler sleeve 30, which will be discussed in detail later. A rotating shaft 25, with a distal threaded portion, protrudes from a first side of the driver pin sleeve 21. The locking spindle 20 further has a protrusion 23 with a keyway slot 24 protruding from a second side thereof. The keyway slot 24 provides a fixed point for the torque arm by means of which the spindle 20 is rotated.

A steel security pin 27 is radially positioned into a pin hole 26 on a circumference of the driver pin sleeve 21, and therein provides security against entry to be obtained by drilling the lock out. The tumbler sleeve 30, with a distributed annular set of blind holes 32, each for receiving a tumbler spring 35 and a tumbler pin 34, is fixed to the tubular casing 10 at the first side of the driver pin sleeve 21 with an anchoring pin 16 which penetrates through a pin hole 13 in the threaded portion of the tubular casing 10 and also penetrates an anchoring hole 31 in the tumbler sleeve 30. Rotation of the locking spindle 20 constitutes locking and unlocking action which is so conventional that no further description is required.

Figure 2:
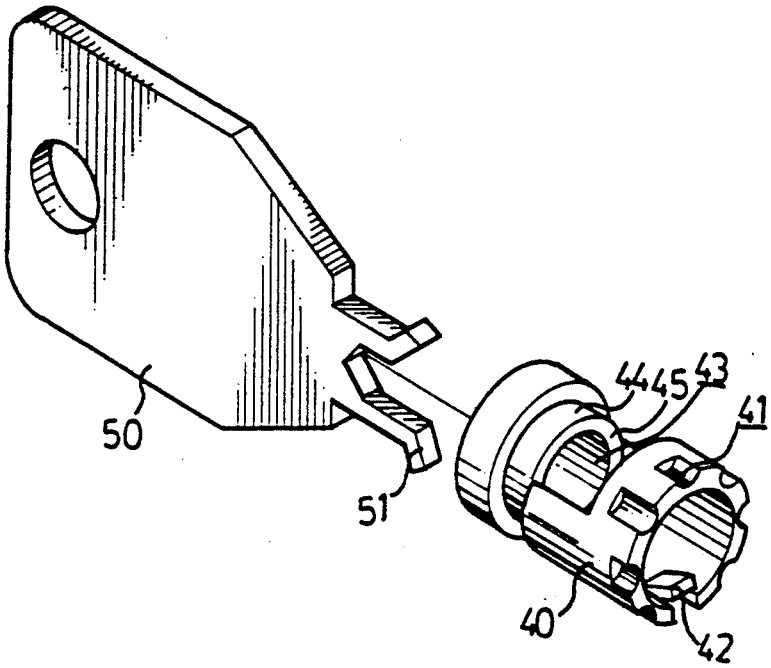
FIG. 2 is an exploded perspective view of a key assembly of a lock system in accordance with the present invention.
Figure 3A:
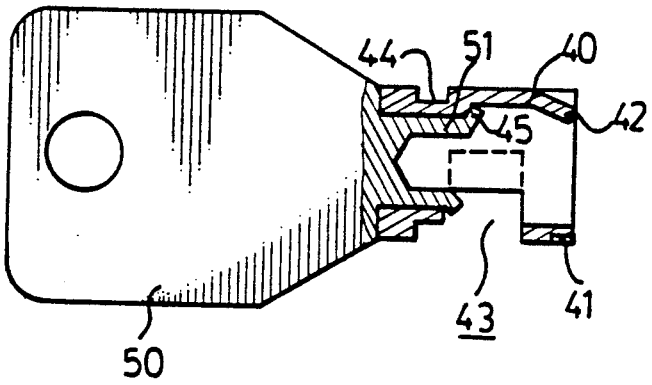
FIG. 3*a* is a side elevational view of an assembled key assembling of the lock system according to the present invention.
Figure 3B:
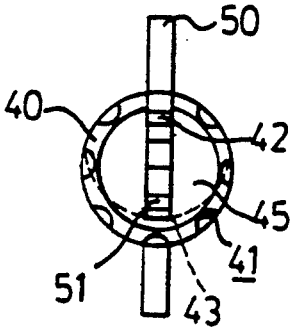
FIG. 3*b* is a right side view of FIG. 3*a;*

Referring to FIGS. 2, 3*a* and 3*b*, the lock system according to the present invention further includes a key comprising a flattened key handle 50 and a cylindrical portion 40. A set of annularly disposed semi-cylindrical slots 41 are formed on an outer periphery of a first end of the cylindrical portion 40, each of a proper depth to engage with corresponding driver pins 33 disposed in the bore holes 22 in the driver sleeve 21. A key guide lug 42 is formed inside the set of the semi-cylindrical slots 41, so as to engage with the keyway slot 21 to turn the rotating shaft and provide the locking or unlocking function The structure and the function of the semi-cylindrical slots 41 and the key guide lug 42 are the same as in prior art, except that there is a cutout portion 43 formed in a middle portion of the cylindrical portion 10. In addition a groove 44 is formed in an outer periphery of a rear portion of the cylindrical portion 40. Like a conventional key, an incorrect key, not providing a proper pattern of slot depths, displaces driver tumblers 33 in such a way that the composite of pin 33, 34 interfaces do not terminate flush with the rotational shear plane between spindle 20 and the tumbler sleeve 30. In an inner wall of the cylindrical portion 40, there is a retaining flange 45 formed thereon for attaching an engaging piece 51 of the flattened key handle 50 with the cylindrical portion 40 to form a complete key, as shown in FIGS. 2 and 3*a*.

Figure 4:
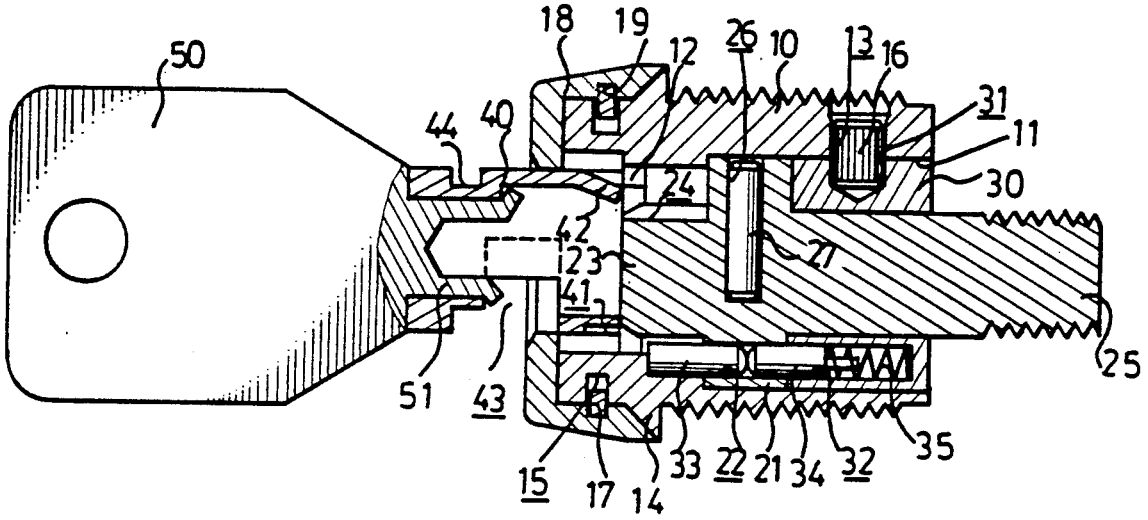

Refer to FIGS. 4 through 7 in which the assembly and operation of the lock system is shown. As can be seen in FIG. 4, the locking spindle 20 is received in the eccentric through hole 11 of the tubular casing 10. The tumbler sleeve 30 is fitted onto the rotating shaft 25 and is adjacent to the first side of the driver pin sleeve 21, and is secured by the anchoring pin passing through the pin hole 13 in the tubular casing 10 and into the anchoring hole 31 in the tumbler sleeve 30. Tumbler springs 35, tumblers 34 and driver tumblers 33 are sequentially installed in the blind holes 31 in the tumbler sleeve 30 and in the bore holes 22 of the driver pin sleeve 21. The driver pins 33 are restrained by the retaining ring 12 formed on the inner peripheral wall of the tubular casing 10.

Figure 8:
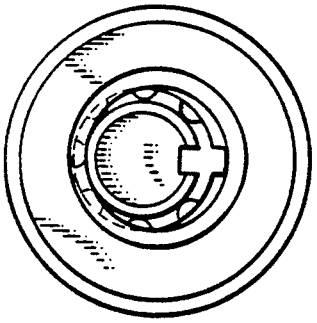
FIG. 8 shows a left side view of a lock mechanism according to the present invention, in which some of the driver tumblers are completely hidden.
Figure 5:
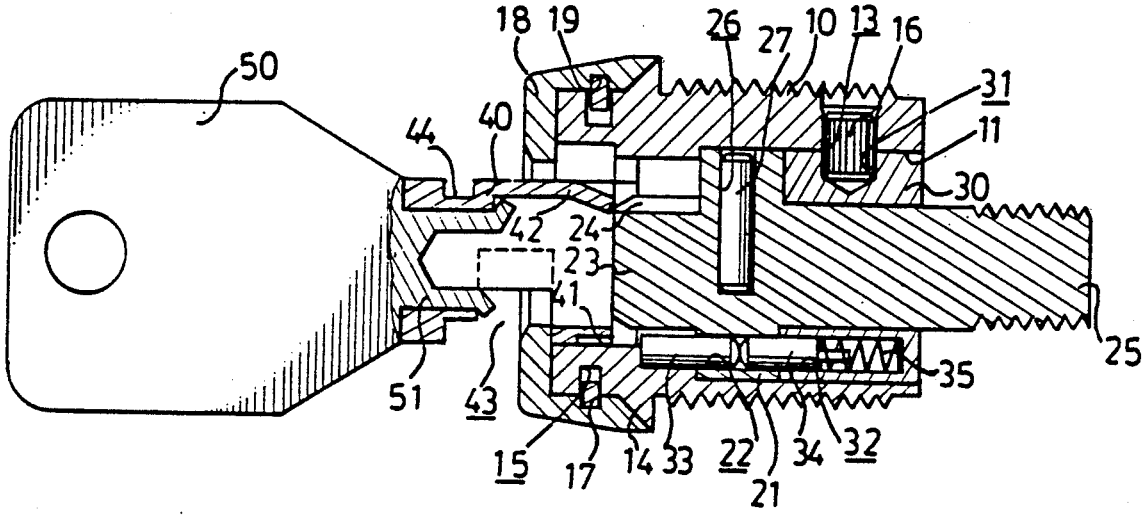

FIG. 4 shows that the key is initially inserted into the lock assembly. However, the first end of the cylindrical portion 40 of the key is stopped by the outer edge of the locking spindle 20. This is because the locking spindle 20 is received in the eccentric hole 11 such that some of the driver tumblers 33 are completely hidden (see FIG. 8). Then, the key is moved downwardly to align the key guide lug 42 of the key with the keyway slot 24 on the driver pin sleeve 21. At this time, as shown in FIG. 5, the key is at its lowest position and rests on the outer cap 18. The key can move downwardly due to the provision of the cutout portion 43.

Subsequently, the key is moved inwardly to push the driver pins 33 and the tumbler pins 34 to act the tumbler springs 33. When the key reaches to a position shown in FIG. 6, the driver pins 33 are completely received in the bore holes 22 and the tumbler pins 34 are completely received in the blind holes 32, such that the locking spindle 20 is rotatable relative to the tumbler sleeve 30. Subsequently, the key can be rotated through a predetermined angle to turn the computer on or off (see FIG. 7).

Figure 6:
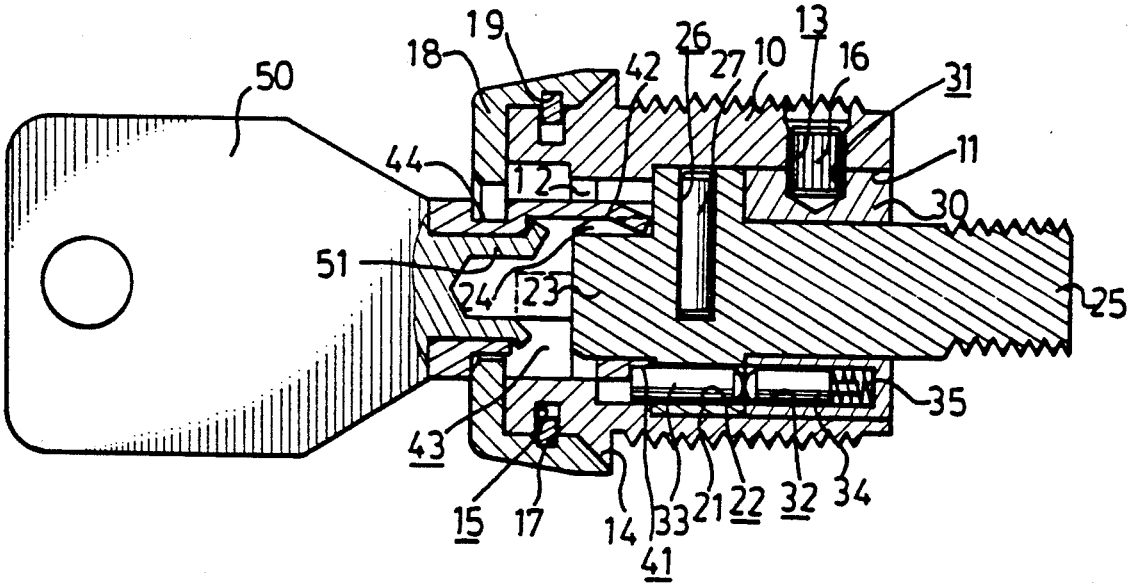
Figure 7:
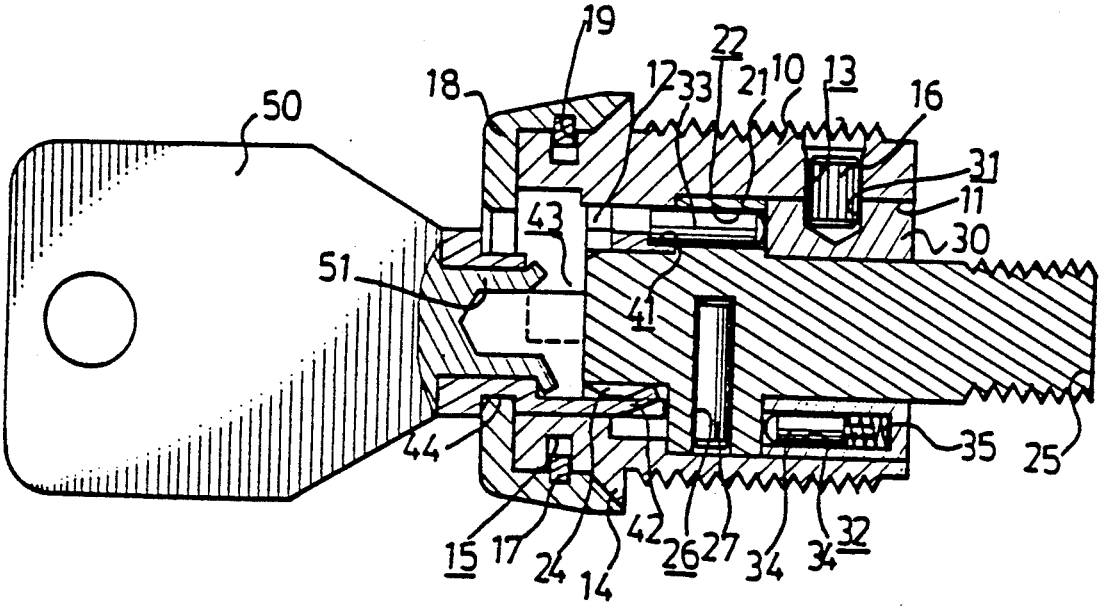

As noted in the above, the cylindrical portion 40 of the key is formed with a cutout and a groove 44, both shown in FIG. 2 and both providing means by which the initially inserted key, from its position as shown in FIG. 4, may be repositioned, aligned, and rotated with the locking spindle 20 in a manner already described. The inner perimeter of the hole in the outer cap 18 provides a rest upon which groove 44 may rotate. The cutout 43 provides space that lock end-protrusion 23 (refer to FIGS. 1, 4, 5, 6 and 7) of the the locking spindle 20 occupies when, as shown in FIGS. 6 and 7, the key is fully inserted and rotated. Lug attachments 51 adjacent to the flattened handle portion 60 of the key provide means by which the flattened portion is attached to the cylindrical portion 40.

The improvements embodied by this invention provide for a better tumbler lock which has a greater resistance to picking attempts by virtue of restricting the potential picker's access to some of the lock's driving tumblers. Because the restriction is simple in design, involving little more than an eccentricly disposed tumbler cylinder in the lock mechanism and some geometric reconfiguration of the key, it is apparent that this system can be economically manufactured.

While these improvements to a tumbler lock have been illustrated and described in terms of a preferred embodiment, and while, at the same time, reference has been made to certain other changes and modifications consistent with the spirit and scope of this invention, neither the preferred embodiment nor any or all changes or modifications referred to herein in the description of the preferred embodiment are intended to be exhaustive of all the changes or modifications which are protected within its spirit and scope. Consequently it is intended that claims, as set forth below and by virtue of expressly stating those features of this tumbler lock which are unique, shall constitute what ought to be considered the proper scope of this invention.

I claim:

1. A tumbler pin lock system for computers comprising a lock mechanism and a key, said lock mechanism comprising an outer tubular casing mounted to a frame of said computer, said tubular casing having an eccentric through hole for rotatably receiving a locking spindle, said locking spindle comprising a driver pin sleeve having a set of bore holes each for receiving a driver pin, a rotating shaft protruding from a first side of said driver pin sleeve, a protrusion with a keyway slot protruding from a second side of said driver pin sleeve, a tumbler sleeve being provided on said rotating shaft next to said first side of said driver pin sleeve and being fixed to said tubular casing by an anchoring means, said tumbler sleeve having a distributed annular set of blind holes each for receiving a tumbler spring and a tumbler pin and being alignable with said bore holes in said driver pin sleeve;

said key comprising a flattened key handle and a substantially cylindrical portion, a set of annularly disposed semi-cylindrical slots being formed on an outer periphery of a first end of said cylindrical portion, each of a proper depth to engage with corresponding driver pins disposed in said bore holes in said driver sleeve, a key guide lug being formed inside said set of semi-cylindrical slots to engage with said keyway slot to rotate said rotating shaft relative to said tumbler sleeve to provide a locking or unlocking function, a cutout portion being formed in a middle portion of said cylindrical portion, a groove being formed in an outer periphery of a rear portion of said cylindrical portion, a retaining flange being on an inner peripheral wall of said cylindrical portion for attaching an engaging piece of said flattened key handle in said cylindrical portion to form a complete key.

2. A tumbler pin lock system as claimed in claim 1 in which a mounting flange protrudes radially from an outer periphery of said tubular casing to divide said outer periphery into a key-end portion and a threaded portion, said lock mechanism being secured to said frame by means of said threaded portion.

3. A tumbler pin lock system as claimed in claim 2, wherein an annular compression ring is fitted in an annular groove on said key-end portion of said tubular casing, an outer cap with an inner groove being press fitted onto said key-end portion of said tubular casing and an upper portion of the compression ring which fits into said inner groove, while securing said outer cap to said tubular casing, provides said outer cap with complete freedom of rotation, said outer cap sealing said key-end portion of said tubular casing which is located outside of said frame.

4. A tumbler pin lock system as claimed in claim 1, further comprising a steel security pin radially positioned into a pin hole on a circumference of said driver pin sleeve, to provide security against entry to be obtained by drilling the lock system out.

* * * * *